US006461276B1

(12) United States Patent
Yu

(10) Patent No.: US 6,461,276 B1
(45) Date of Patent: Oct. 8, 2002

(54) HAND-SHAKING EXERCISER OUTFITTED WITH INTERNAL INERTIA ROTOR

(76) Inventor: Hui-Nan Yu, 14, Lane 252, Chien Kuo Road, Taoyuan (TW)

( * ) Notice: Subject to any disclaimer, the term of this patent is extended or adjusted under 35 U.S.C. 154(b) by 0 days.

(21) Appl. No.: 10/044,981

(22) Filed: Jan. 15, 2002

(51) Int. Cl.[7] ..... A63B 21/22
(52) U.S. Cl. ..... 482/44; 482/110; 601/107
(58) Field of Search ..... 482/44, 45, 46, 482/49, 50, 148, 110; 472/137; 446/233, 266; 601/107

(56) References Cited

U.S. PATENT DOCUMENTS 5,766,112 A * 6/1998 Chuan ..... 482/44
5,800,311 A * 9/1998 Chuang ..... 482/44
6,053,846 A * 4/2000 Lin ..... 482/45
6,099,444 A * 8/2000 Domenge ..... 482/110
6,241,637 B1 * 6/2001 Basyuk ..... 482/44

* cited by examiner

*Primary Examiner*—Steven R. Crow
(74) *Attorney, Agent, or Firm*—Troxell Law Office PLLC

(57) ABSTRACT

A hand-shaking exerciser outfitted with an internal rotor comprises a hollow casing and a rotor shaft. The hollow casing consists of two identical semispherical shells interlocked integrally and extending outward to form two handles. At the far top of the shell, many small hard pellets are installed. The internal inertia rotor shaft is composed of two crown plates, an inertia weight and a wheel plate, one of which has an oval head at one side and one sleeve at other to receive the inertia weight. Two crown plates will hold and lock the inertia weight and wheel plate firmly to constitute an integral rotor shaft. When the player holds the handles and shakes the exerciser, the rotor shaft will make a free inertia rolling within the casing. The vigorous rolling of the rotor shaft will produce powerful vibration force acting as a massaging force to achieve the practical purpose.

2 Claims, 5 Drawing Sheets

HAND-SHAKING EXERCISER OUTFITTED WITH INTERNAL INERTIA ROTOR

FIELD OF THE INVENTION

This invention relates to a hand-shaking exerciser outfitted internally with an inertia rotor shaft, in particular, the rotor shaft will produce an inertia rolling within the hand-shaking exerciser.

BACKGROUND OF THE INVENTION

Nowadays, the leisure activities are numerous and the sports materials that are available either in the gymnasium or in houses are very popular, are good for the public to promote healthcare in the leisure time. However, most sports materials are designed with complicated structure and bulky in volume, not easy for handling, requiring spacious storage room, not becoming available at the exact time when the player wants to play.

For this reason, based on the real requirement to keep availability of the sports materials all the time as the player wishes, the inventor has devoted great efforts for years to the professional research and development and eventually come up with the birth of this hand-shaking exerciser with internal illuminant rotor shaft.

SUMMARY OF THE INVENTION

The key object of the invention is to provide a hand-shaking exerciser outfitted with internal inertia rotor shaft, designed in compact structure, easy for handling and operation, let the player have the option to pick it up at any leisure time to practice the hand exercise as he desires.

The significant features and technology of this invention are expressed in great detail with the aid of embodiments as illustrated in the drawings attached.

DETAILED DESCRIPTION OF THE INVENTION

Figure 1:
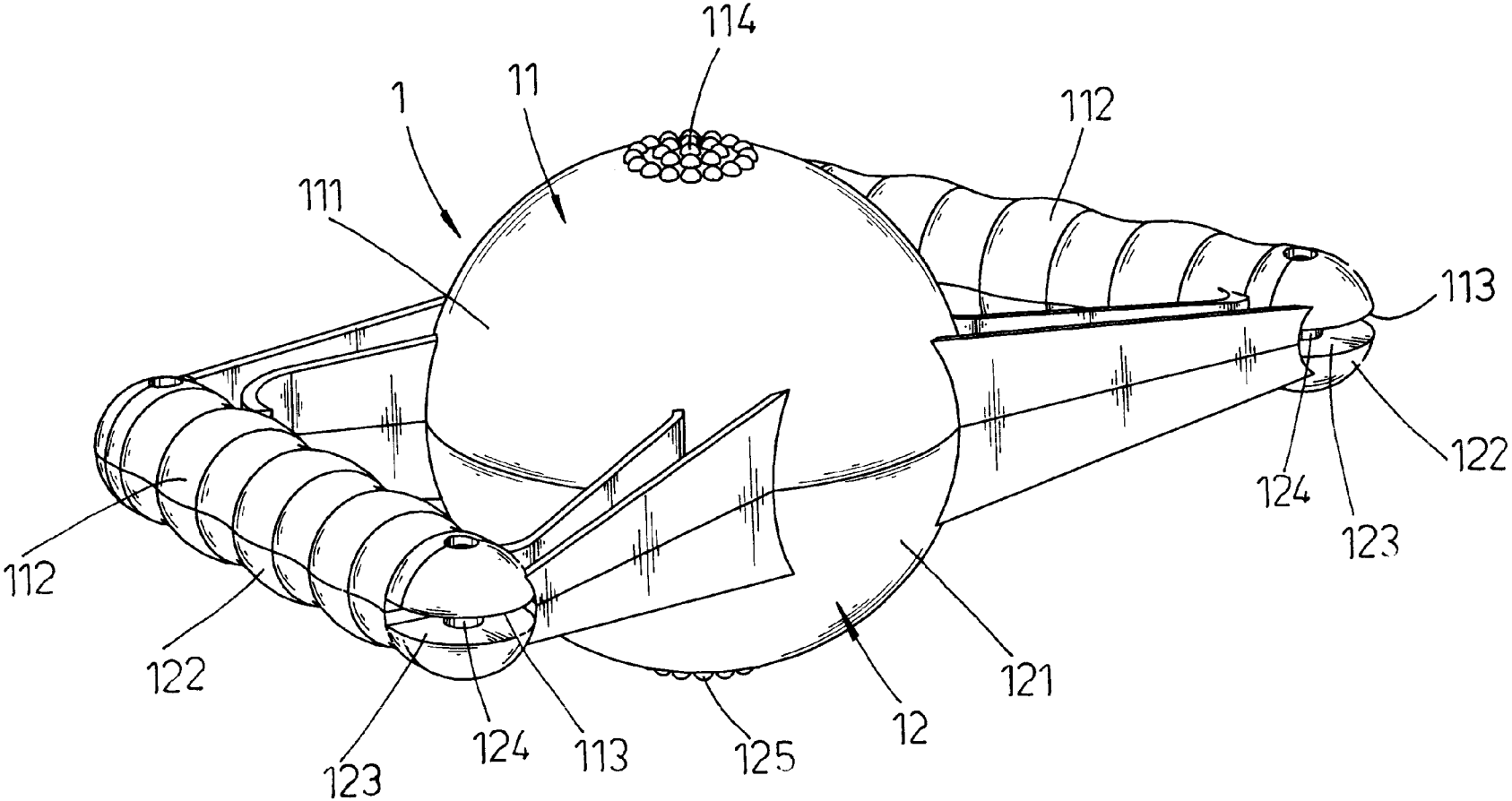
FIG. 1 is a stereo outlook of the hand-shaking exerciser of the invention.
Figure 2:
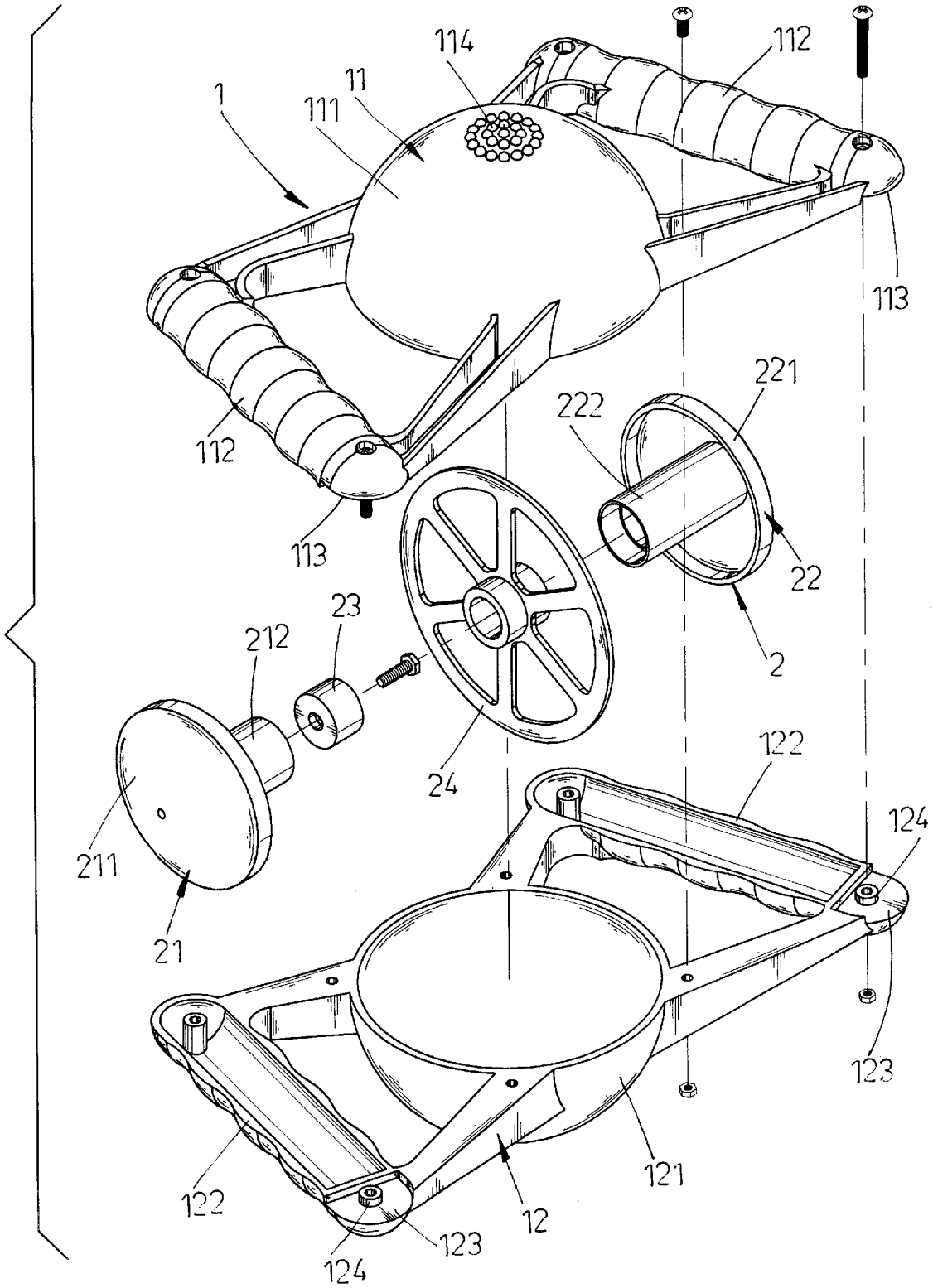
FIG. 2 is a disassembly of the hand-shaking exerciser of the invention.
Figure 3:
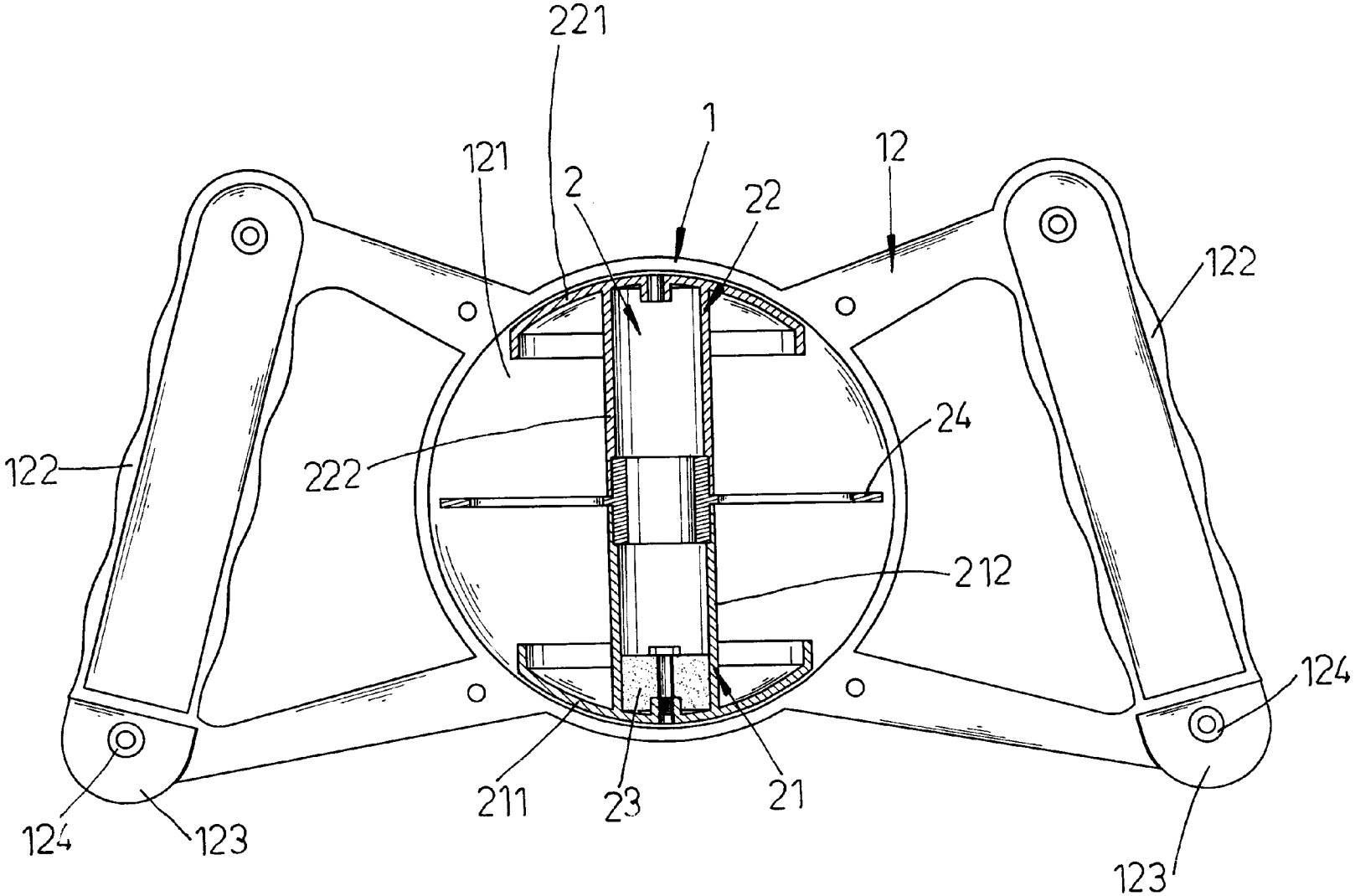
FIG. 3 is a cross section the hand-shaking exerciser of the invention.
Figure 4:
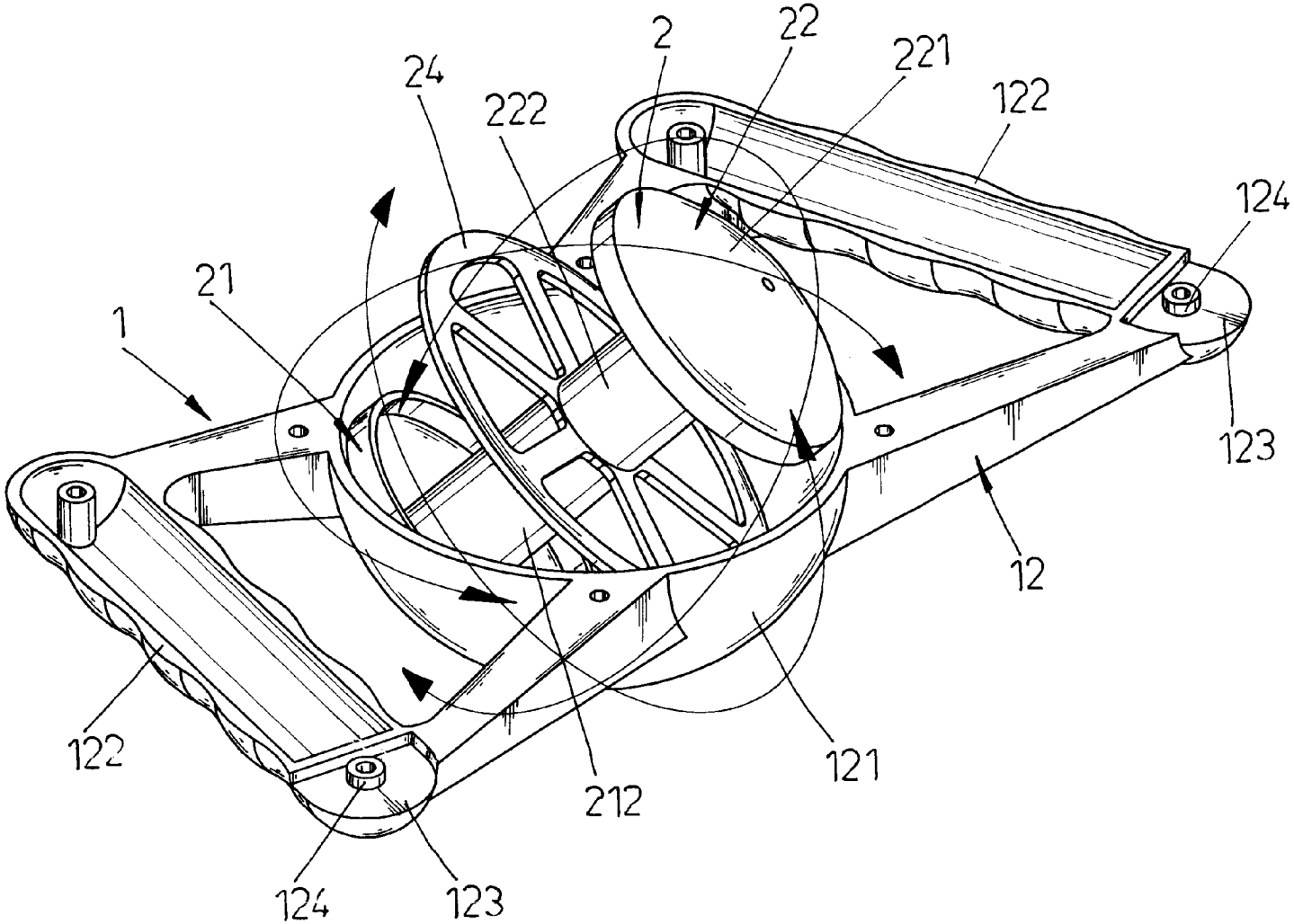
FIG. 4 shows an inertia rolling action of the rotor shaft of the hand-shaking exerciser of the invention.

As shown in FIGS. 1 through 4, the casing 1 of the invention contains a rotor shaft 2. Where the casing 1 is composed of two identical semispherical shells 11 and 12 interlocked together. The semispherical shells 11 and 12 extend outward from the arch centers 111 and 121 to form two butterfly-type handles 112 and 122. Slot 113 and 123 are provided at both ends of handles 112 and 122. In the slot 123, there is an upright post 124. Two clusters of small hard pellets 114 and 125 are installed at the center top of the semispherical shells 11 and 12.

The rotor shaft 2 comprises two crown plates 21 and 22, an inertia weight 23 and a wheel plate 24, where the crown plates 21 and 22 have oval heads 211, 221 on one side, permissible to slide within the inner arch surfaces 111 and 121 of two semispherical shells 11 and 12, and sleeves 212 and 222 on the other side. When the crown plates 21 and 22 are interlocked to form an I-type axial shaft having a diameter less than the inner arch surfaces 111 and 121 of the semispherical shells 11 and 12. The I-type axial shaft constitutes a sleeve 212 of crown plate 21 to receive the inertia weight 23 and the wheel plate 24 which is sandwiched by two sleeves 212 and 222 of two crown plates 21 and 22. The outer diameter is smaller than that of the I-type axial shaft. When the I-type axial shaft freely rolls within the inner arch surfaces 111 and 121, the wheel plate 24 rotates with the I-type axial shaft too.

It is learned that two inner arch surfaces 111 and 121 form a hollow space in the casing 1, permitting the rotor shaft 2 to roll therein. When the player holds two handles 112 and 122 on the casing 1 and shakes it along an orbit on the body, the rotor shaft 2 rolls freely and violently in the hollow space organized by the inner arch surfaces 111 and 121, and two clusters of pellets 114 and 125 produce a vibration which is finally translated into massaging effect. Playing this exerciser achieve the objectives of body massaging and hand practice, very valuable.

Figure 5:
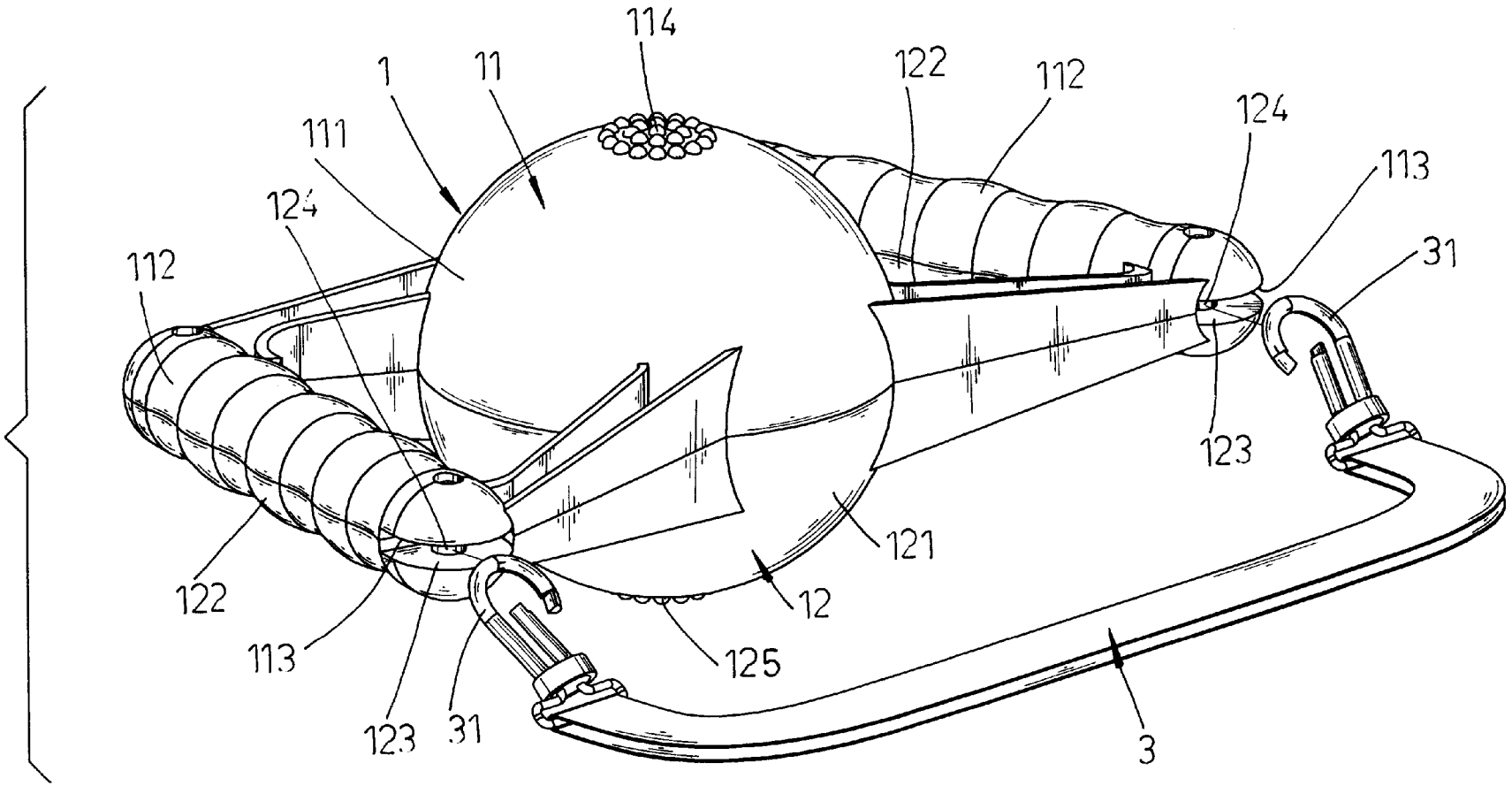
FIG. 5 shows an addition of a belt to the hand-shaking exerciser of the invention.

FIG. 5 shows another embodiment of the invention in which the slots 113 and 123 of the handles 112 and 122 are provided with a belt 3 and bolt ring 31 which is hooked on the upright post 124 in the slot 123. It is convenient for the player to massage the back by hanging the belt 3 along the waist line. In addition, the wheel plate 24 can be made a colorful wheel to intensify the diverse fun while the rotor shaft 2 is rolling in the casing 1.

From the above statement, this invention provides a hand exerciser with internal inertia rotor shaft has a brand new ideal and a simplified design which will achieve the predetermined objective.

Many changes and modifications in the above disclosed embodiment of the invention can, of course, be carried out without departing from the scope thereof. Accordingly, to promote the progress in science and the useful arts, the invention is disclosed and is intended to be limited only by the scope of the appended claims.

What is claimed is:

1. A hand-shaking exerciser, mainly comprising a casing containing a rotor shaft characterized in that:

said casing consists of two identical semispherical shells extending outward to form two handles, two clusters of hard pellets attached to a top center of said shells;

said rotor shaft constitutes two crown plates, an inertia weight and a wheel plate, said crown plates present an oval head on one side and a sleeve on the other side, permissible to slide along inner arch surfaces of said semispherical shells, said sleeves are interlocked to form said rotor shaft having an outer diameter smaller than that of said arch surfaces, an inertia weight is fixed on one sleeve and two sleeves sandwich said wheel plate in place; and said rotor shaft is housed in a hollow space formed by two arch surfaces of said semispherical shells and said inertia weight is held in said rotor shaft, when a player holds two handles and shakes it along an orbit, said rotor shaft will roll freely with inertia effect in said hollow space to provoke a violent vibration, together with actions of said clustered pellets, it further produces massaging effects as well as arm exercise.

2. The hand-shaking exerciser of claim 1, wherein each far end of said handles provides a slot and an upright post for hanging a belt and a swivel.